US008878734B2

(12) United States Patent
Williams

(10) Patent No.: US 8,878,734 B2
(45) Date of Patent: Nov. 4, 2014

(54) ANTENNA SUPPORT STRUCTURES

(75) Inventor: Eddie Williams, Los Osos, CA (US)

(73) Assignee: iRobot Corporation, Bedford, MA (US)

( * ) Notice: Subject to any disclaimer, the term of this patent is extended or adjusted under 35 U.S.C. 154(b) by 347 days.

(21) Appl. No.: 13/340,456

(22) Filed: Dec. 29, 2011

(65) Prior Publication Data

US 2012/0194395 A1 Aug. 2, 2012

Related U.S. Application Data

(60) Provisional application No. 61/432,512, filed on Jan. 13, 2011.

(51) Int. Cl.
*H01Q 1/32* (2006.01)
*H01Q 1/08* (2006.01)
*H01Q 1/12* (2006.01)

(52) U.S. Cl.
CPC ..... *H01Q 1/085* (2013.01); *H01Q 1/32* (2013.01); *H01Q 1/1221* (2013.01)
USPC ..... 343/713; 343/715; 343/878

(58) Field of Classification Search
CPC ..... B29C 45/00; B29L 2031/32; B60R 16/04
USPC ..... 343/713, 715, 878, 880, 881
See application file for complete search history.

(56) References Cited

U.S. PATENT DOCUMENTS

| | | | | | |
|---|---|---|---|---|---|
| 1,933,959 | A | * | 11/1933 | Block | 343/872 |
| 2,388,625 | A | * | 11/1945 | Wagenknecht | 343/714 |
| 2,391,202 | A | * | 12/1945 | Tellander et al. | 52/110 |
| 2,546,026 | A | * | 3/1951 | Coon | 174/86 |
| 2,932,367 | A | * | 4/1960 | Odenwald | 52/292 |

FOREIGN PATENT DOCUMENTS

| | | | | |
|---|---|---|---|---|
| JP | 05191122 | * | 7/1993 | H01Q 1/50 |

* cited by examiner

*Primary Examiner* — Tho G Phan
(74) *Attorney, Agent, or Firm* — Honigman Miller Schwartz and Cohn LLP

(57) ABSTRACT

An antenna support structure for a remote vehicle comprises a tubular mast configured to demonstrate a non-linear response to radial force. The mast is rigid and configured to hold an antenna approximately perpendicular to a base of the mast at equilibrium during operation of the remote vehicle and elastically buckle in response to a predetermined radial force on the antenna. The support structure is also configured to return to equilibrium once the predetermined radial force is removed.

20 Claims, 7 Drawing Sheets

ANTENNA SUPPORT STRUCTURES

This application claims the benefit of U.S. Provisional Patent Application No. 61/432,512, filed Jan. 13, 2011, the entirety of which is incorporated herein by reference.

FIELD

The present teachings relate generally to antenna support structures. More specifically, the present teachings relate to flexible antenna support structures providing improved antenna performance for robot communications.

BACKGROUND

The section headings used herein are for organizational purposes only and are not to be construed as limiting the subject matter described in any way.

Antennas are generally mounted upon rigid support structures, such as, for example, an antenna mast. The support structure positions the antenna in view of a target radio signal and maintains the antenna's orientation despite vehicular movement and/or environmental factors such as wind, rain, and blowing debris.

When used in robotic applications, antenna support structures may also require a significant amount of flexibility. A robot, for example, may roll or otherwise hit its antenna on various objects during its normal course of operation and/or have its antenna folded for storage, thereby requiring the support structure to adequately absorb such forces (i.e., compressive and/or radial loads) without permanently bending or breaking.

To maximize the responsiveness of an antenna (i.e., to position and maintain the antenna in view of a target radio signal), it may be desirable, therefore, to provide an antenna support structure that is relatively straight and rigid under normal operating conditions such as, for example, driving over rough terrain which would tend to cause an antenna to want to wag. To prevent damage to an antenna when the antenna is severely bent, it also may be desirable to provide an antenna support structure that readily buckles under increased loads (i.e., in response to compressive and/or radial loads). It may be desirable, therefore, to provide an antenna support structure with a non-linear response to deflection forces exerted upon the antenna, which may buckle under a predetermined radial force, but regain a relatively straight and rigid form upon removal of the force.

SUMMARY

The present teachings may solve one or more of the above-mentioned problems and/or achieve one or more of the above-mentioned desirable features. Other features and/or advantages may become apparent from the description which follows.

The present teachings provide an antenna support structure for a remote vehicle. The support structure comprises a tubular mast configured to demonstrate a non-linear response to radial force. The mast is rigid and configured to hold an antenna approximately perpendicular to a base of the mast at equilibrium during operation of the remote vehicle and elastically buckle in response to a predetermined radial force on the antenna. The support structure is also configured to return to equilibrium once the predetermined radial force is removed.

The present teachings also provide antenna support structures comprising: a tubular mast; a mast base coupled to a first end of the mast; a mast cap coupled to a second end of the mast; a radio frequency connector coupled to the mast cap, the radio frequency connector being configured to receive an antenna; and a radio frequency cable coupled to the radio frequency connector, the radio frequency cable extending within the mast from the mast base to the mast cap. In a first state, the mast is rigid and straight, and in a second state, the mast elastically buckles in response to a predetermined radial force.

The present teachings further provide antenna support structures comprising: a tubular mast; a mast base coupled to a first end of the mast, the mast base being configured to attach to a robotic vehicle; a mast cap coupled to a second end of the mast; a radio frequency connector coupled to the mast cap, the radio frequency connector being configured to receive an antenna; and a radio frequency cable coupled to the radio frequency connector, the radio frequency cable extending within the mast from the mast base to the mast cap. The antenna support structure providing a non-linear response to radial force.

Additional objects and advantages of the present teachings will be set forth in part in the description which follows, and in part will be obvious from the description, or may be learned by practice of the present teachings. The objects and advantages of the present teachings can be realized and attained by means of the elements and combinations particularly pointed out in the appended claims.

It is to be understood that both the foregoing general description and the following detailed description are exemplary and explanatory only and are not restrictive of the present teachings, as claimed.

The accompanying drawings, which are incorporated in and constitute a part of this specification, illustrate exemplary embodiments of the present teachings and together with the description, serve to explain the principles of those teachings.

DESCRIPTION

Reference will now be made in detail to exemplary embodiments of the present teachings, examples of which are illustrated in the accompanying drawings.

The present teachings relate to flexible antenna support structures, such as, for example, antenna masts, which can improve the performance of an antenna on a remote vehicle such as, for example, an iRobot® PackBot®. An antenna support structure providing increased antenna durability and transmission range can be achieved in accordance with the present teachings by utilizing a tubular mast configured to demonstrate a non-linear response to radial force. Masts in accordance with the present teachings may, for example, effectively form a detent, which rigidially holds an antenna substantially perpendicular to or at a similar desired angle relative to a base of the mast against moderate vibrational forces (e.g., as the vehicle moves through a given terrain), but which is overcome and elastically buckles in response to a predetermined radial force on the antenna (e.g., from the weight of the vehicle, from obstacles in the path of the vehicle, and/or for storage of the vehicle). Furthermore, when the radial force is removed from the antenna, masts in accordance with the present teachings may demonstrate a brief oscillation cycle, wherein each oscillation of the mast through the detent position (i.e., the predetermined desired position) greatly dampens the oscillation of the mast. Thus, upon removal of the predetermined radial force, the mast may quickly return to equilibrium, bringing the antenna back to the desired position. To simplify explanation of the present teachings, the desired position of the mast described herein will be perpendicular to the base of the mast.

In various exemplary embodiments, antenna support structures in accordance with the present teachings may be attached to and/or integrated with mobile robots, such as, for example, to support a radio antenna on a robotic vehicle such as an iRobot® PackBot®. Those of ordinary skill in the art would understand, however, that the antenna support structures of the present teachings are useful in various radio applications, improving communications (i.e., antenna performance) for various remote vehicles, and are not intended to be limited in any way by the exemplary embodiments discussed above and below with regard to robotic systems.

Figure 1:
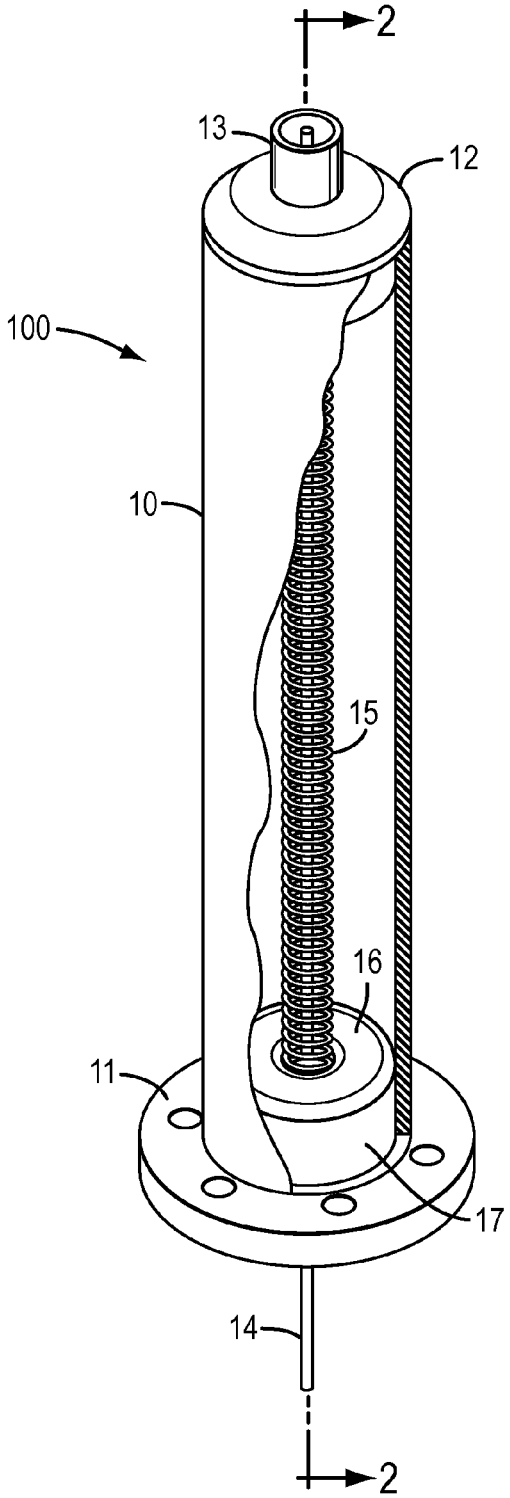
FIG. 1 is a perspective view of an exemplary embodiment of an antenna support structure in accordance with the present teachings, with a portion of an outer wall being cut away.
Figure 2:
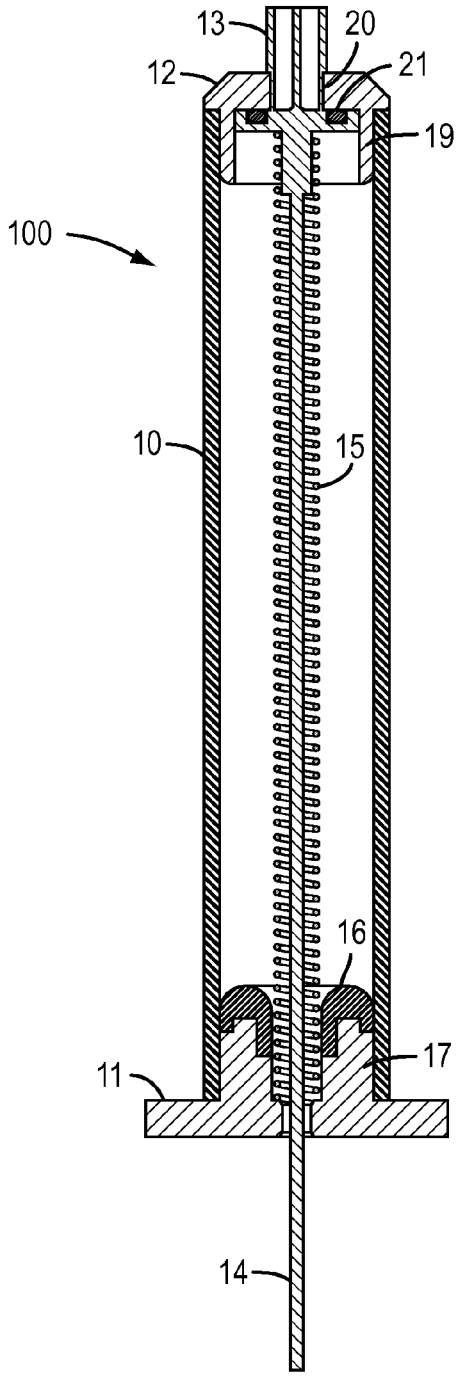
FIG. 2 is a cross-sectional view of the antenna support structure of FIG. 1, taken through line 2-2 in FIG. 1.

With reference now to FIGS. 1 and 2, perspective and cross-sectional views of an exemplary embodiment of an antenna support structure 100 are shown. The antenna support structure 100 comprises a tubular mast 10, a mast base 11, and a mast cap 12.

As used herein, the term "tubular mast" refers to a mast generally having the form of a tube. Those of ordinary skill in the art would understand, therefore, that tubular masts may generally have a cylindrical, hollow cavity, within which material may pass between the mast base and the mast cap. Those of ordinary skill in the art would also understand, however, that tubular masts, as used herein, may further comprise masts which are effectively circular (i.e., function in relatively the same manner), such as, for example, oval tubes, which may deflect more easily in two directions, or many-sided polygonal tubes. Accordingly, those of ordinary skill in the art would understand that the present teachings are not limited to masts with a circular cross-section as illustrated in the exemplary embodiment of FIGS. 1 and 2.

In various exemplary embodiments of the present teachings, the mast 10 may comprise, for example, a silicon tube. In various embodiments, the mast 10 has a diameter ranging from about 0.5 inches to about 6 inches, a wall thickness ranging from about 0.0625 inches to about 0.5 inches, and a length ranging from about 2 inches to about 24 inches. In various embodiments the mast 10 may, therefore, have a length to diameter ratio of about 4:1; and a diameter to wall thickness ratio ranging from about 8:1 to about 12:1. Those of ordinary skill in the art would understand, however, that the mast 10 may have various configurations (e.g., diameters, lengths, and/or wall thicknesses) and be formed from various elastic materials including, for example, rubber materials and/or shape memory alloys (SMAs), and that the configuration and material used for the mast 10 may be chosen as desired based on application, strength, cost, response to deflection force and other such design factors.

Figure 5:
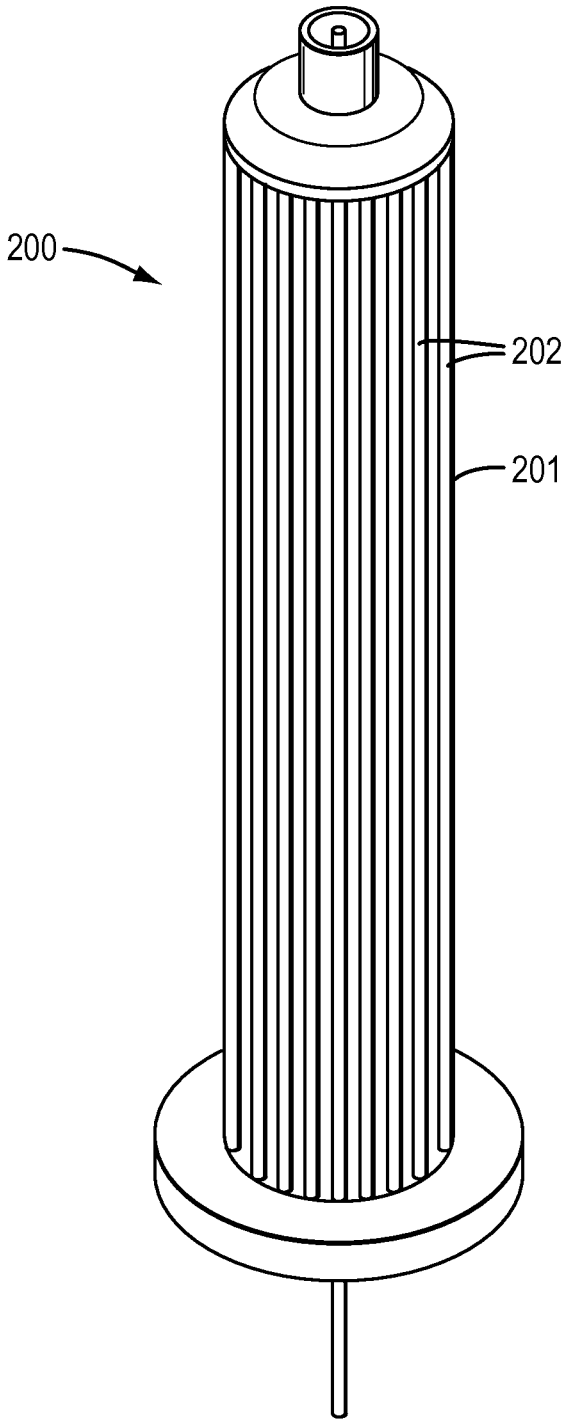
FIG. 5 is a perspective view of another exemplary embodiment of an antenna support structure in accordance with the present teachings.

For applications in which a rubber tube might be damaged (e.g., for larger vehicles) upon remote vehicle rollover, FIG. 5 illustrates an exemplary embodiment of an antenna support structure 200 that can, for example, comprise a mast 201 having a plurality of elongated, shape memory alloy (e.g., nickel titanium (NiTi)) strands 202. As shown in FIG. 5, the strands 202 may be arranged to form a flexible cylinder similar to the mast of FIGS. 1 and 2. Those of ordinary skill in the art would understand, however, that FIG. 5 is exemplary only and that mast 201 may have various configurations (e.g., cross sectional shapes, diameters, lengths, and numbers and/or thicknesses of strands 202) and be formed from various suitably strong but elastic materials (e.g., SMAs). Those of ordinary skill in the art would understand, for example, that the number and thickness of strands 202 may be chosen based on a particular application, wherein the number/thickness of strands 202 is proportional to the amount of weight that the mast 201 can support (i.e., the more strands, the more weight).

In various embodiments, the mast 201 comprises at least three strands 202. In various additional embodiments, the mast 201 may further comprise a protective coating, such as, for example, a rubber coating around the outer periphery of the either individual strands 202 or surrounding the strands 202 as a group, as would be understood by those of ordinary skill in the art.

Figure 3:
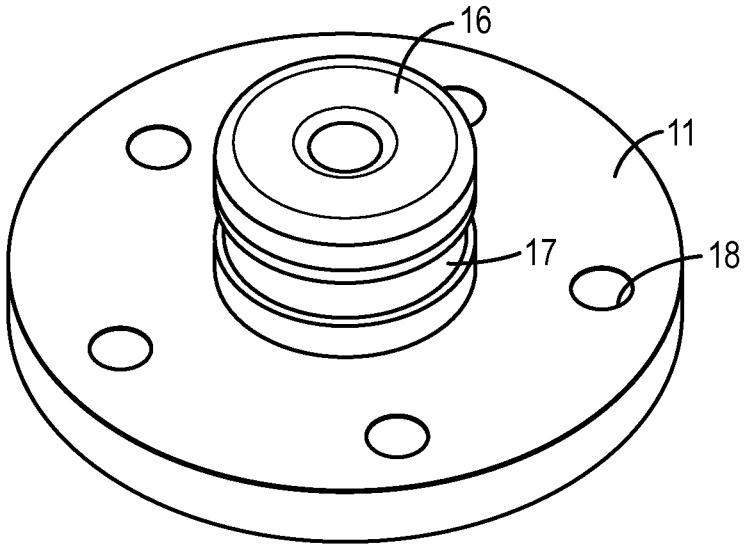
FIG. 3 is an enlarged view of the mast base and grommet of FIG. 2.
Figure 4:
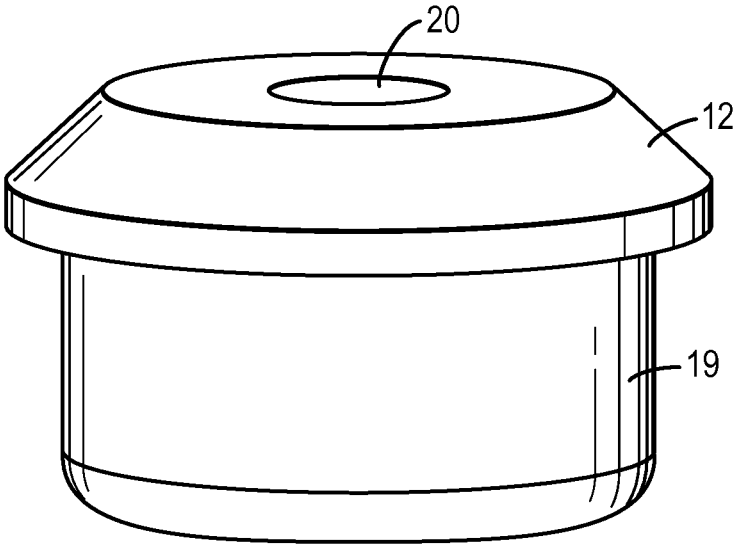
FIG. 4 is an enlarged view of the mast cap of FIG. 2.

With reference again to FIGS. 1 and 2, the mast base 11 is coupled to a first end of the mast 10 and the mast cap 12 is coupled to a second end of the mast 10, wherein the mast 10 extends longitudinally between the base 11 and the cap 12. As shown in FIGS. 2-4, for example, in various exemplary embodiments, the mast base 11 and the mast cap 12 respectively comprise flanges 17 and 19, which respectively receive the first and second ends of the mast 10. Those of ordinary skill in the art would understand, however, that the mast base 11 and the mast cap 12 may have various configurations and/or features to engage and maintain the mast's cross-section. Those of ordinary skill in the art would also understand that the mast 10 may be secured to the mast base 11 and the mast cap 12 (e.g., via flanges 17 and 19) using various fastening mechanisms, including, but not limited to, various types of screws, bolts, adhesives and/or welding mechanisms. Furthermore, those of ordinary skill in the art would understand that the mast base 11 and the mast cap 12 may be formed from various materials including, for example, plastic and/or metal materials, and that the configuration and material used for the base 11 and cap 12 may be chosen as desired based on application, strength, cost and other such design factors.

As shown in FIGS. 1 and 2, to receive a radio antenna, a radio frequency (RF) connector 13 is coupled to the mast cap 12. In various embodiments, the RF connector 13 may, for example, extend through the mast cap 12 via a bore 20 in the mast cap 12 as illustrated in FIGS. 2 and 4. Those of ordinary skill in the art would understand that the RF connector 13 may be secured within the mast cap 12 using various fastening mechanisms, including, but not limited to, various types of screws, bolts, adhesives and/or welding mechanisms. In various embodiments, for example, the RF connector 13 may be secured and sealed within the flange 19 via screws (not shown) and an O-ring 21.

In various exemplary embodiments, the RF connector 13 may comprise a standard RF connector, such as, for example, a reverse polarity subminiature version A (RP-SMA), subminiature version A (SMA), micro-miniature coaxial (MMCX), or type N (N) connector as would be understood by those of ordinary skill in the art. Those of ordinary skill in the art would also understand, however, that various types of RF connectors can be employed, which may receive various interchangeable commercially available antennas. A radio frequency (RF) cable 14 extends within the mast 10 from the mast base 11 (e.g., via flange 17) to the mast cap 12 and is coupled to the RF connector 13 at the mast cap 12. In various embodiments, the RF cable 14 may comprise, for example, a standard coaxial cable for transmitting radio frequency (RF) signals between a vehicle's radio and the antenna. Accordingly, when the antenna support structure is attached to a vehicle, the RF cable 14 may pass through the mast base 11 via a bore (not shown) into the interior of the vehicle to connect with the vehicle's radio (See, e.g., FIG. 6).

As shown in FIG. 2, in various embodiments of the present teachings, the antenna support structure 100 may further comprise a cable protection spring 15. The cable protection spring 15 may, for example, extend within the mast 10 from the mast base 11 to the mast cap 12 and provide an impact resistant sheath around the RF cable 14. As those of ordinary skill in the art would understand, in various embodiments, spring 15 is a coil type spring, which may act like a flexible spinal column to protect the RF cable 14 from direct impacts to the mast 10 and enforce a minimum bend radius so that the RF cable 14 within the spring 15 is protected from kinks and/or sharp bends that may damage its RF properties. Those of ordinary skill in the art would further understand, however, that the spring 15 may have various configurations (e.g., diameters, lengths, and/or spring constants) and be formed from various flexible materials including, for example, hardened steel and various non-ferrous materials, and that the configuration and material used for the spring 15 may be chosen as desired based on application, strength, flexibility, cost, the minimum bend radius exhibited and other such design factors.

As shown in FIGS. 2 and 3, in various additional embodiments, the antenna support structure 100 may further comprise an optional grommet 16 coupled to the mast base 11. The grommet 16 may, for example, sit upon the flange 17 to provide a soft, rounded surface, which may distribute force (e.g., radial force) along the length of mast 10, thus preventing pinching and/or other crush damage to the mast 10, the cable protection spring 15, and/or the RF cable 14 in the event of an impact directly at the base of the mast 10. As those of ordinary skill in the art would understand, the grommet 16 may have various configurations and be formed from various materials including, for example, rubber and metal materials. In various embodiments of the present teachings, for example, the grommet 16 and the flange 17 may be integrated to form one, uniform piece (i.e., a flange with soft, rounded edges) as illustrated, for example, in the embodiment of FIG. 6.

Figure 6:
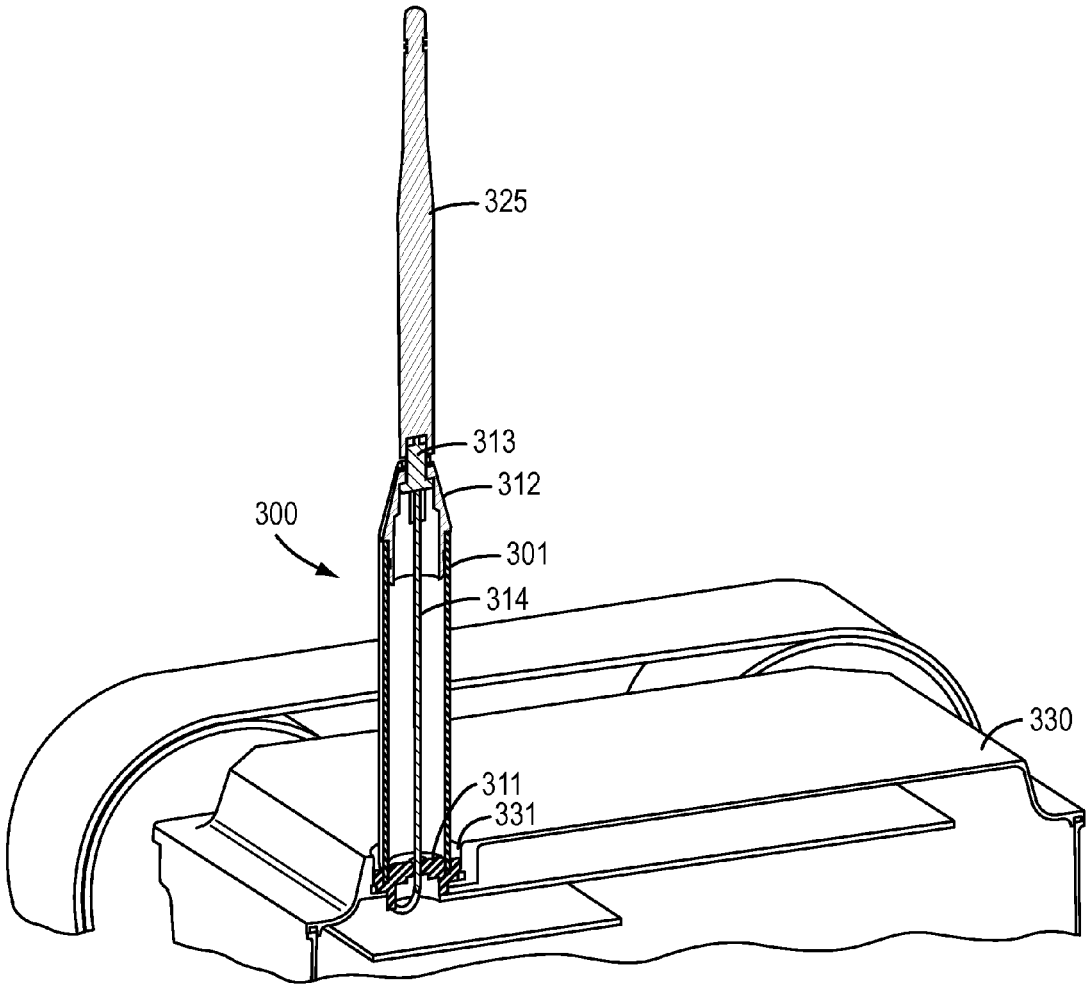
FIG. 6 is a cross-sectional view of another exemplary embodiment of an antenna support structure in accordance with the present teachings, integrated with a robotic vehicle in accordance with the present teachings.

As shown in FIGS. 1 and 3, the mast base 11 is configured to attach the antenna support structure 100 to a remote vehicle, such as, for example, a robotic vehicle 330 as illustrated in FIG. 6. In various embodiments, for example, a plurality of holes 18 may be spaced evenly around an outer surface of the base 11. In various additional embodiments, mounting of the base 11 to the robotic vehicle 330 is accomplished via a plurality of fasteners (e.g., mounting screws and/or bolts) (not shown) mounted within the holes 18 to secure the mast base 11 to the vehicle. Those of ordinary skill in the art would understand, however, that various types, sizes, numbers, and/or configurations of holes and/or fasteners can be used without departing from the scope of the present teachings. Those of ordinary skill in the art would further understand that the mast base 11 may be secured to a vehicle using various fastening mechanisms, including, but not limited to, various types of screws, bolts, adhesives and/or welding mechanisms.

With reference now to FIG. 6, in various exemplary embodiments, an antenna support structure 300 is attached to a robotic vehicle 330 via a mast base 311. To protect the base if, for example, the vehicle 330 receives an impact in the area of the mast base, for example from being dropped or rolling over, mast base 311 may be embedded within a well 331 on a top surface of the vehicle 330 as illustrated in FIG. 6. As above, an RF cable 314 extends within a mast 301 from the mast base 311 to a mast cap 312 and is coupled to an RF connector 313 at the mast cap 312. The RF cable 314 may comprise, for example, a standard coaxial cable for transmitting radio frequency (RF) signals between the vehicle's radio and an antenna 325. As shown in FIG. 6, the RF cable 314 may pass through the mast base 311 into the interior of the vehicle 330 to connect with the vehicle's radio (not shown).

Figure 7:
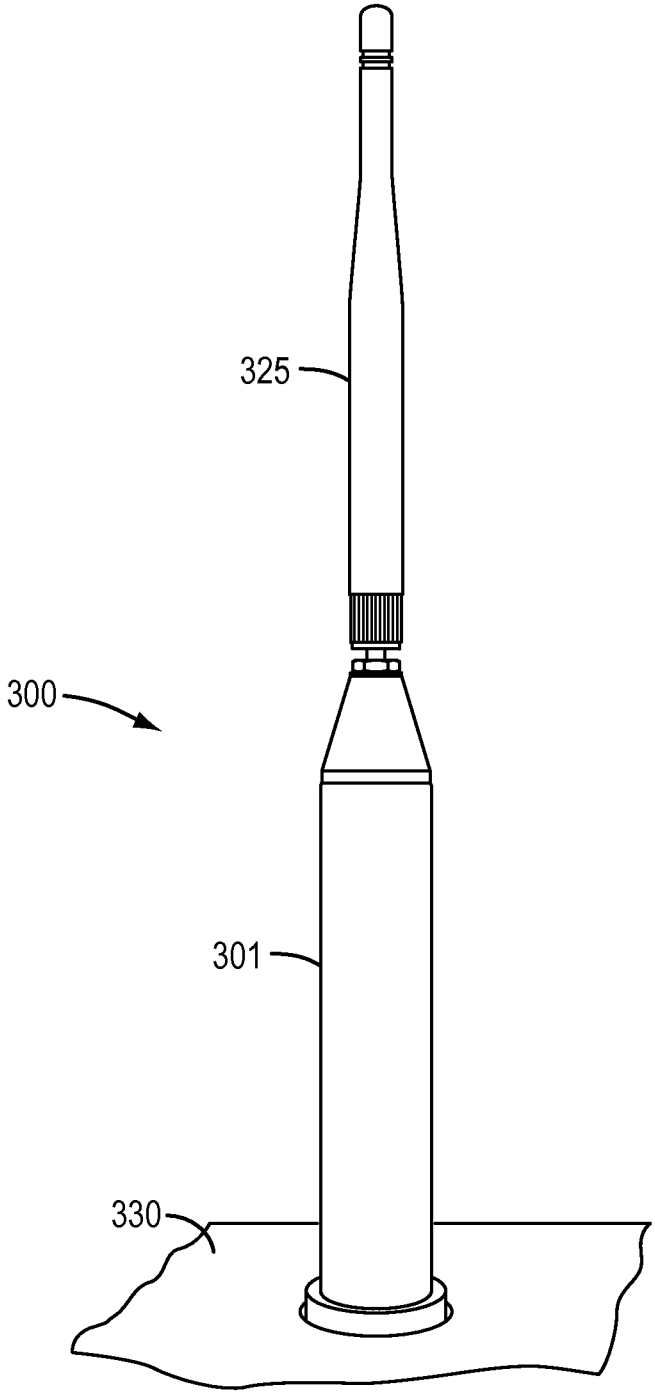
FIG. 7 is a perspective view of the antenna support structure of FIG. 6 in a rigid and straight configuration.
Figure 9:
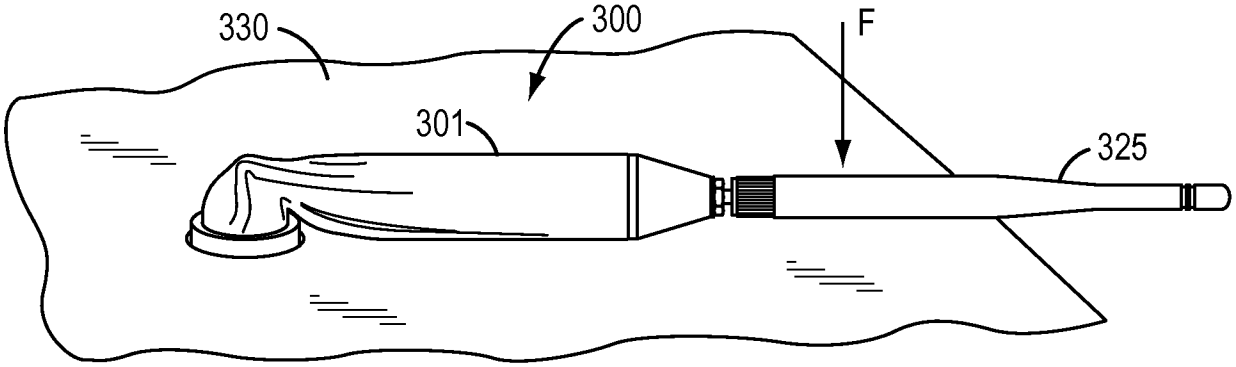
FIG. 9 is a perspective view of the antenna support structure of FIG. 6 elastically buckling in response to a radial force applied to the antenna.

As would be understood by those of ordinary skill in the art, during operation of the vehicle 330, the mast 301 may effectively form a detent, which rigidly holds the antenna 325 perpendicular to the mast base 311 against moderate vibrational forces (e.g., as the vehicle 330 moves) as illustrated in FIG. 7, but which is overcome and elastically buckles in response to a predetermined radial force F on the antenna 325 (e.g., from the weight of the vehicle 330 and/or from obstacles in the path of the vehicle 330) as illustrated in FIG. 9.

As shown in FIG. 7, in a first state, the mast 301 is rigid and straight, holding the antenna 325 approximately perpendicular to the mast base 311 (i.e., the mast 301 is at equilibrium). As would be understood by those of ordinary skill in the art, due to the non-linear response of the tubular mast 301 (e.g., the silicon tube) to radial force, the mast 301 is able to minimize waving and oscillation from vibrations associated with the vehicle 330 traversing, for example, uneven ground (i.e., the mast 301 may maintain equilibrium against light to moderate vibrational forces).

As used herein, the term "non-linear response" refers to a response that does not satisfy the superposition principle, or a response of the tubular mast (i.e., output) that is not directly proportional to the radial force applied (i.e., input) to the tubular mast. Thus, unlike conventional flexible antenna support structures, which generally allow an antenna to wave back and forth during vehicle movement, antenna support structures of the present teachings keep the antenna in a vertical position.

As would be further understood by those of ordinary skill in the art, conventional omni-directional antennas, such as those generally employed on robotic vehicles, typically have their strongest reception along a plane that intersects, and is perpendicular to, the antenna axis. Thus, depending on the antenna used, the signal strength can be concentrated in a thin disk radiating from the antenna, or in a less concentrated torus with several adjacent lobes as illustrated respectively, for example, in FIGS. 8A and 8B. In all cases, however, as the corresponding radio with which the vehicle is trying to communicate moves from the plane toward the axis of the antenna, signal strength is reduced, often with sharp non-linear reductions in signal strength between lobes.

Figure 8A:
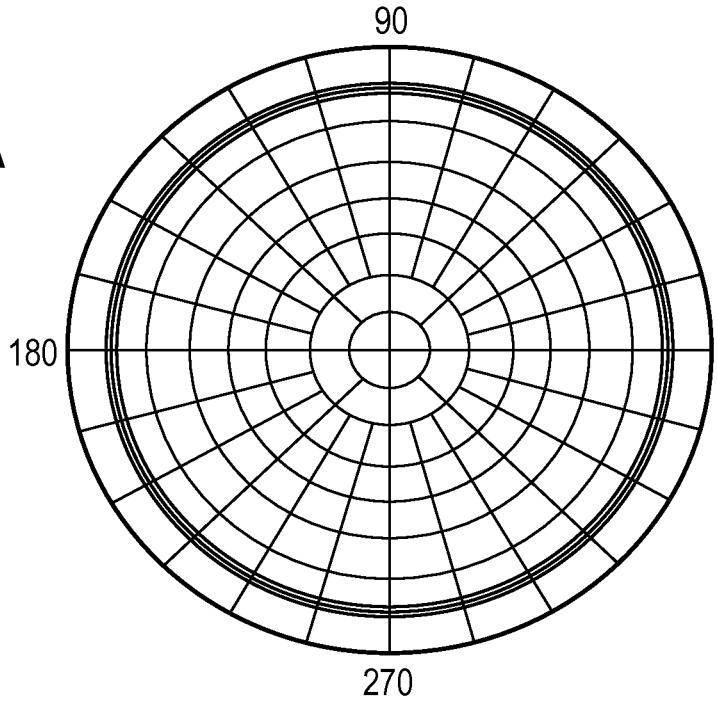
FIGS. 8A and 8B illustrate a series of antenna plots for an exemplary antenna used in conjunction with the antenna support structure of FIG. 6.
Figure 8B:
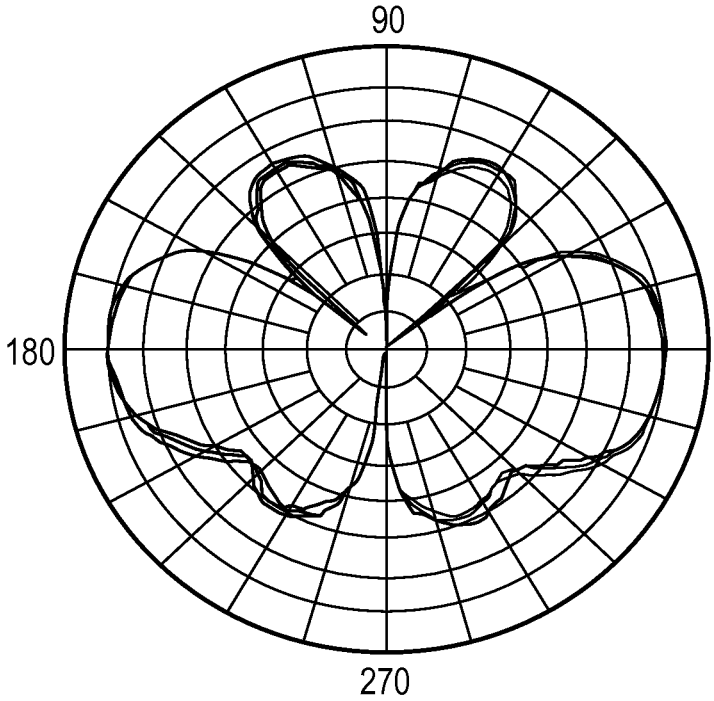

FIGS. 8A and 8B illustrate a series of antenna plots for an exemplary antenna 325 used in conjunction with the antenna support structure of FIG. 6. In various embodiments, for example, antenna 325 may comprise a 2.4 GHz APXtender "Rubber Duck" Omni-directional antenna manufactured by Pacific Wireless, a unit of Laird Technologies®. FIG. 8A illustrates the H-plane reference frame (i.e., coinciding with the horizontal/azimuth plane) and FIG. 8B illustrates the E-Plane reference frame (i.e., coinciding with the vertical/elevation plane) for the antenna 325. Those of ordinary skill in the art would understand, however, that FIGS. 8A and 8B are exemplary only and that antenna designs may be varied to optimize an antenna's H-plane and E-plane reference frames. Furthermore, the present teachings contemplate use of other types of antennas in addition or alternative to the illustrated vertically polarized, omni-directional antenna 325. An omni-directional antenna, as used herein, includes antennas that radiate power uniformly in one plane, with the radiated power decreasing with elevation angle above or below the plane, and dropping to zero on the antenna's axis.

Thus, if the antenna 325 is allowed to wave around (instead of being held vertical to keep the strongest lobes of signal strength going out along the ground to the operator (i.e., the radio in which the vehicle 330 is trying to communicate)), loss of signal strength received by the operator may occur randomly. As shown in FIG. 8B, for example, if the antenna 325 is angled toward the operator by approximately 37 degrees, the antenna's signal strength is reduced by several decibels (potentially cutting off communications with each swing of the antenna). Thus, to maintain communications, it is important for the antenna 325 to remain as vertical as possible while the vehicle 330 is driving forward.

As shown in FIG. 9, in a second state, the mast 301 may elastically buckle in response to a predetermined radial force F on the antenna 325. As would be understood by those of ordinary skill in the art, due to the non-linear response of the tubular mast 301 (e.g., the silicon tube) to radial force, the mast 301 maintains a vertical position, as described above, which may be quickly overcome in response to a predetermined radial force F on the antenna 325 from, for example, (1) the weight of the vehicle 330 if it rolls or falls on its back, (2) the vehicle 330 driving forward under an obstacle that is lower than the height of the antenna 325, or (3) the antenna 325 being deliberately folded over when the vehicle is put into storage. By buckling in response to compressive and/or radial loads, masts of the present teachings have a much smaller bend radius than, for example, conventional spring-based flexible antenna support structures, which demonstrate a substantially linear response to such loads. Thus, as illustrated in FIG. 9, masts in accordance with the present teachings may fold sharply directly at their base, increasing the mast's resistance to strains that could cause permanent deformation to the antenna. Furthermore, by buckling in response to compressive and/or radial loads, masts of the present teachings may also minimize the load to which the vehicle chassis is subjected when the antenna is flexed (i.e., reducing the antenna's deflection also reduces the stress on the antenna connection to the chassis).

As would be understood by those of ordinary skill in the art, as above, due to the non-linear response of the tubular mast 301 to radial force, when the radial force F is removed from the antenna 325, the mast 301 may quickly return to equilibrium, bringing the antenna back to a vertical position (i.e., rather than starting a long cycle of oscillation).

As discussed above, antenna support structures in accordance with the present teachings are useful in various radio applications and are scalable, for example, to any size remote vehicle, allowing for improved communications (i.e., antenna performance). It will be appreciated by those of ordinary skill in the art having the benefit of this disclosure that the present teachings provide antenna support structure embodiments for various small robotic vehicles. Further modifications and alternative embodiments of various aspects of the present teachings will be apparent to those skilled in the art in view of this description. For example, those of ordinary skill in the art would understand that for an antenna element with a given mass, a mast can be selected with a diameter and wall thickness that will not buckle from the antenna's swinging mass (which would start an oscillation), but will buckle easily under greater side or compressive loading (i.e. a predetermined radial force). The heavier the antenna, for example, the stiffer the mast needs to be to prevent the mast from buckling under the antenna's own weight. Similarly, the taller (i.e., longer) the antenna, the stiffer the mast needs to be to counteract the leverage provided by the antenna at the tip of the mast. Accordingly, the diameter and/or wall thickness of the mast may be increased to support a heavier and/or taller antenna.

As used herein, the term "a predetermined radial force" refers to the amount of radial force required to buckle a particular antenna support structure (i.e., the force determined to buckle an individual mast configuration). Those of ordinary skill in the art would understand, therefore, that the predetermined radial force is correlated to a particular antenna support structure and varies depending upon application. Furthermore, those of ordinary skill in the art would be able to determine the predetermined radial force for a given support structure based on a particular application.

Furthermore, it will be appreciated by those of ordinary skill in the art having the benefit of this disclosure that the present teachings may also provide antenna support structure embodiments for various additional applications, such as, for example, satellite and/or cellular applications. Further modifications and alternative embodiments to accommodate such applications would be apparent to those skilled in the art in view of this description.

The antenna support structure embodiments may also include additional components that were omitted from the drawings for clarity of illustration and/or operation. Accordingly, this description is to be construed as illustrative only and is for the purpose of teaching those skilled in the art the general manner of carrying out the present teachings. It is to be understood that the various embodiments shown and described herein are to be taken as exemplary. Elements and materials, and arrangements of those elements and materials, may be substituted for those illustrated and described herein, parts may be reversed, and certain features of the present teachings may be utilized independently, all as would be apparent to one skilled in the art after having the benefit of the description herein. Changes may be made in the elements described herein without departing from the spirit and scope of the present teachings and following claims, including their equivalents.

It is to be understood that the particular examples and embodiments set forth herein are non-limiting, and modifications to structure, dimensions, materials, and methodologies may be made without departing from the scope of the present teachings.

For the purposes of this specification and appended claims, unless otherwise indicated, all numbers expressing quantities, percentages or proportions, and other numerical values used in the specification and claims, are to be understood as being modified in all instances by the term "about" if they are not already. Accordingly, unless indicated to the contrary, the numerical parameters set forth in the following specification and attached claims are approximations that may vary depending upon the desired properties sought to be obtained by the present teachings. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

It is noted that, as used in this specification and the appended claims, the singular forms "a," "an," and "the," and any singular use of any word, include plural referents unless expressly and unequivocally limited to one referent. As used herein, the term "include" and its grammatical variants are intended to be non-limiting, such that recitation of items in a list is not to the exclusion of other like items that can be substituted or added to the listed items.

It should be understood that while the present teachings have been described in detail with respect to various exemplary embodiments thereof, it should not be considered limited to such, as numerous modifications are possible without departing from the broad scope of the appended claims, including the equivalents they encompass.

What is claimed is:

1. An antenna support structure for a remote vehicle, the support structure comprising a tubular mast configured to demonstrate a non-linear response to radial force, the mast being rigid and configured to hold an antenna approximately perpendicular to a base of the mast at equilibrium during operation of the remote vehicle and elastically buckle in response to a predetermined radial force on the antenna, the mast having a length-to-diameter ratio of about 4:1 and a diameter-to-wall thickness ratio ranging from about 8:1 to about 12:1, and the support structure being configured to return to equilibrium once the predetermined radial force is removed.

2. The antenna support structure of claim 1, wherein the tubular mast comprises a silicon tube.

3. The antenna support structure of claim 1, wherein the tubular mast comprises a plurality of nickel titanium strands.

4. An antenna support structure comprising:

a tubular mast having a length-to-diameter ratio of about 4:1 and a diameter-to-wall thickness ratio ranging from about 8:1 to about 12:1;

a mast base coupled to a first end of the mast;

a mast cap coupled to a second end of the mast;

a radio frequency connector coupled to the mast cap, the radio frequency connector being configured to receive an antenna; and a radio frequency cable coupled to the radio frequency connector, the radio frequency cable extending within the mast from the mast base to the mast cap, wherein, in a first state, the mast is rigid and straight, and wherein, in a second state, the mast elastically buckles in response to a predetermined radial force.

5. The antenna support structure of claim 4, further comprising a cable protection spring, the cable protection spring being configured to provide a sheath around the radio frequency cable.

6. The antenna support structure of claim 4, further comprising a grommet coupled to the mast base, the grommet being configured to distribute the radial force.

7. The antenna support structure of claim 4, wherein the tubular mast comprises a silicon tube.

8. The antenna support structure of claim 4, wherein the tubular mast comprises a plurality of nickel titanium strands.

9. The antenna support structure of claim 8, wherein the tubular mast further comprises a protective coating around an outer periphery of the strands.

10. The antenna support structure of claim 4, wherein the tubular mast has a length to diameter ratio of about 4:1.

11. The antenna support structure of claim 10, wherein the tubular mast has a diameter to wall thickness ratio ranging from about 8:1 to about 12:1.

12. The antenna support structure of claim 4, wherein the mast base is configured to attach the antenna support structure to a remote vehicle.

13. An antenna support structure comprising:

a tubular mast having a length-to-diameter ratio of about 4:1 and a diameter-to-wall thickness ratio ranging from about 8:1 to about 12:1;

a mast base coupled to a first end of the mast, the mast base being configured to attach to a robotic vehicle;

a mast cap coupled to a second end of the mast;

a radio frequency connector coupled to the mast cap, the radio frequency connector being configured to receive an antenna; and a radio frequency cable coupled to the radio frequency connector, the radio frequency cable extending within the mast from the mast base to the mast cap, wherein the antenna support structure provides a non-linear response to radial force.

14. The antenna support structure of claim 13, further comprising a cable protection spring, the cable protection spring being configured to provide a sheath around the radio frequency cable.

15. The antenna support structure of claim 13, further comprising a grommet coupled to the mast base, the grommet being configured to distribute the radial force.

16. The antenna support structure of claim 13, wherein the tubular mast comprises a silicon tube.

17. The antenna support structure of claim 13, wherein the tubular mast comprises a plurality of shape memory alloy strands.

18. The antenna support structure of claim 17, wherein the tubular mast further comprises a protective coating around an outer periphery of the strands.

19. The antenna support structure of claim 13, wherein the tubular mast comprises at least three nickel titanium strands.

20. The antenna support structure of claim 13, wherein the tubular mast has a diameter ranging from about 0.5 inches to about 6 inches, a length ranging from about 2 inches to about 24 inches, and a wall thickness ranging from about 0.0625 inches to about 0.5 inches.

* * * * *